US012571062B2

(12) United States Patent
Weinberg et al.

(10) Patent No.: US 12,571,062 B2
(45) Date of Patent: Mar. 10, 2026

(54) PROCESS FOR PRODUCING RAW STEEL AND AGGREGATE FOR PRODUCTION THEREOF

(71) Applicant: ThyssenKrupp Steel Europe AG, Duisburg (DE)

(72) Inventors: Matthias Weinberg, Krefeld (DE); Frank Ahrenhold, Duisburg (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 431 days.

(21) Appl. No.: 18/020,157

(22) PCT Filed: Aug. 3, 2021

(86) PCT No.: PCT/EP2021/071630
§ 371 (c)(1),
(2) Date: Feb. 7, 2023

(87) PCT Pub. No.: WO2022/033921
PCT Pub. Date: Feb. 17, 2022

(65) Prior Publication Data

US 2023/0323491 A1 Oct. 12, 2023

(30) Foreign Application Priority Data

Aug. 12, 2020 (EP) ..... 20190705

(51) Int. Cl.
*C21C 5/52* (2006.01)
*C21B 11/02* (2006.01)

(52) U.S. Cl.
CPC ..... *C21C 5/5211* (2013.01); *C21B 11/02* (2013.01)

(58) Field of Classification Search
CPC ..... C21C 5/5211; C21C 5/35; C21C 5/54; C21C 5/562; C21C 7/072; C21C 7/10;
(Continued)

(56) References Cited

U.S. PATENT DOCUMENTS

2002/0005083 A1* 1/2002 Dimitrov ..... C21C 5/567 75/10.63
2007/0272054 A1 11/2007 Pleschiutschnigg et al.
(Continued)

FOREIGN PATENT DOCUMENTS

CN 1183476 A 6/1998
CN 1236398 A 11/1999
(Continued)

OTHER PUBLICATIONS

CN10648126A Translation (Year: 2017).*
(Continued)

*Primary Examiner* — Danielle M. Carda
(74) *Attorney, Agent, or Firm* — RMCK Law Group PLC

(57) ABSTRACT

The invention relates to a process for producing low-nitrogen crude steel. This process includes melting directly reduced iron and/or scrap in a melting furnace with arc resistance heating to give a metallic melt and a slag. The metallic melt is removed from the melting furnace and used to charge a converter. The metallic melt is refined in the converter to give liquid crude steel. The liquid crude steel is tapped having a nitrogen content [N] of not more than 50 ppm, especially of not more than 30 ppm.

13 Claims, 4 Drawing Sheets

Figure 1:
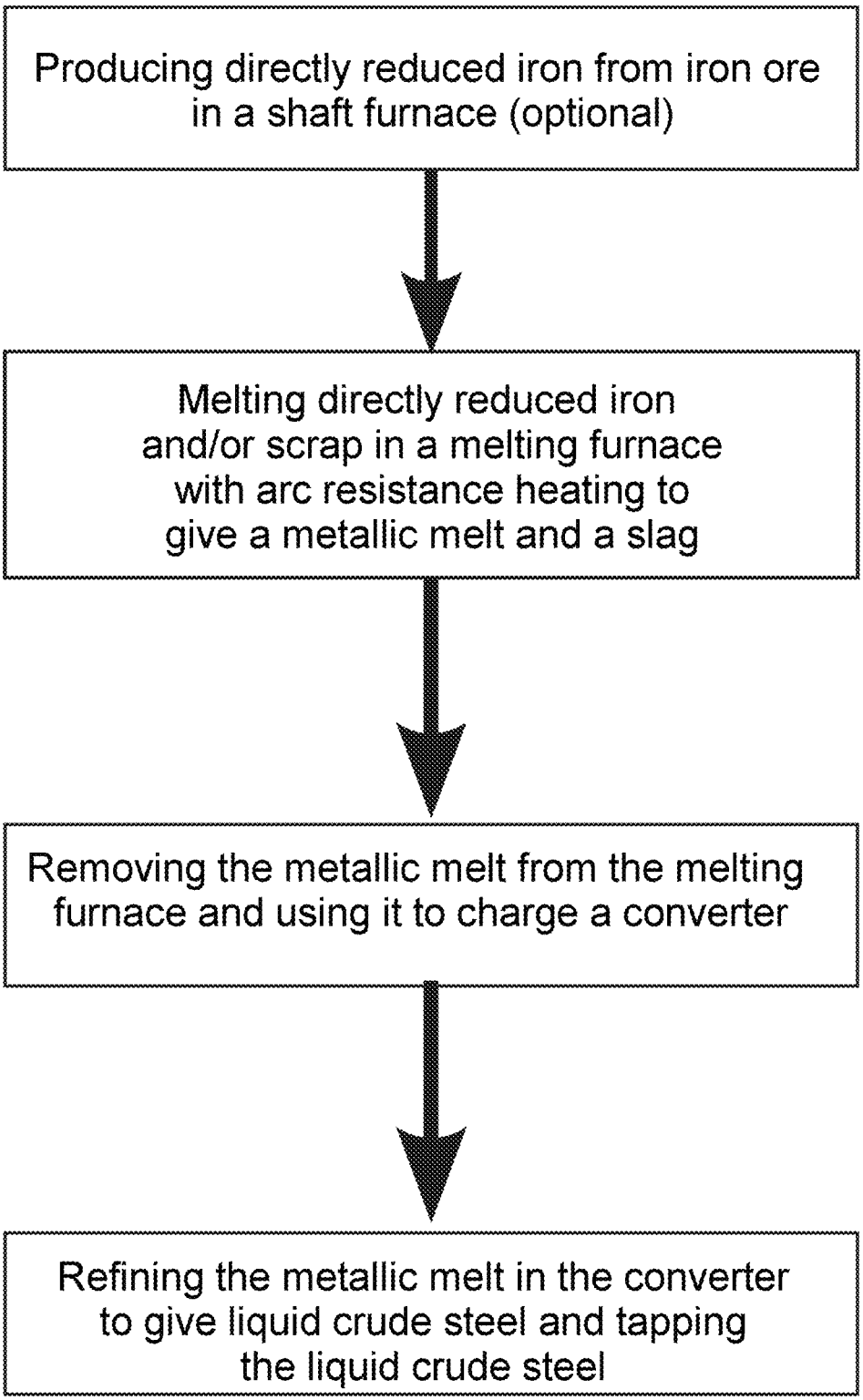

(58) Field of Classification Search
CPC ... C21C 5/5229; C21B 11/02; C21B 2300/02; Y02P 10/20
USPC ..... 75/10.66, 10
See application file for complete search history.

(56) References Cited

U.S. PATENT DOCUMENTS

| | | | | |
|---|---|---|---|---|
| 2015/0259760 | A1* | 9/2015 | Eder | C25B 1/04 75/505 |
| 2016/0326606 | A1 | 11/2016 | Al-Zeghaibi | |
| 2021/0108284 | A1* | 4/2021 | Pickett | C22B 1/244 |

FOREIGN PATENT DOCUMENTS

| | | | | |
|---|---|---|---|---|
| CN | 106498126 | A * | 3/2017 | C21C 7/076 |
| JP | S60234916 | A | 11/1985 | |
| JP | S6240306 | | 2/1987 | |
| JP | S6295617 | A | 5/1987 | |
| JP | H05195041 | A | 8/1993 | |
| JP | H11140530 | A | 5/1999 | |
| JP | 2000204410 | A | 7/2000 | |
| JP | 2007211298 | A | 8/2007 | |
| JP | 2011084752 | A | 4/2011 | |
| JP | 2015161021 | A | 9/2015 | |
| JP | 2015529751 | A | 10/2015 | |
| JP | 2016141873 | | 8/2016 | |
| WO | 9920802 | A1 | 4/1999 | |
| WO | 2004108971 | A2 | 12/2004 | |
| WO | 2018193243 | A1 | 10/2018 | |
| WO | 2019082762 | | 5/2019 | |
| WO | 2020004501 | A1 | 1/2020 | |

OTHER PUBLICATIONS

International Search Report and Written Opinion for International Application No. PCT/EP2021/071630 mailed Oct. 12, 2021.
Lankford, Jr., W. et al., "The Making, Shaping and Treating of Steel", United States Steel, 10th Edition, Association of Iron and Steel Engineers, 1985.
Submission regarding third party objections dated Feb. 3, 2023.

* cited by examiner

PROCESS FOR PRODUCING RAW STEEL AND AGGREGATE FOR PRODUCTION THEREOF

CROSS-REFERENCE TO RELATED APPLICATIONS

This application is a 371 U.S. National Stage of International Application No. PCT/EP2021/071630, filed Aug. 3, 2021, which claims the benefit of European Patent Application No. 20190705.2 filed Aug. 12, 2020. The disclosures of each of the above applications are incorporated herein by reference in their entirety.

In modern-day steel production, essentially two different routes are used: firstly the blast furnace-converter route and secondly the electrical steel route. In the blast furnace-converter route, the iron ore is reduced and melted in the blast furnace with addition of coke. Subsequently, the resultant metallic melt is oxidized ("refined") with oxygen in an oxygen-blown converter. This oxidizes trace elements having oxygen affinity in the metallic melt (for example carbon, silicon, manganese, phosphorus), which are discharged in the form of gas or slag. In the electrical steel route, the starting material used is directly reduced iron ("iron sponge"), in some cases in briquet form, and/or scrap. This starting material is melted in an electric arc furnace and can likewise be freed of constituents having oxygen affinity by blowing in oxygen; cf., for example, WO 2004/108971 A1.

The blast furnace-converter route has the disadvantage that reduction with coke in the blast furnace releases very large amounts of $CO_2$. By contrast, the electrical steel route has the disadvantage that, in general, the removal of elements having oxygen affinity and impurities introduced by scrap is less efficient. In the electrical steel route, the level of trace elements and impurities has to be reduced further by complex downstream secondary metallurgy methods. For that reason, the electrical steel route is used essentially for construction steels and long products for which higher contents of trace elements are allowed.

Crude steel having low contents of trace elements that serves as starting material, for example for ULC steel grades, such as IF steels and non-grain-oriented electrical strip, is produced almost exclusively via the blast furnace-converter route. Therefore, the appropriate assemblies are also present globally in steelworks in order to produce a suitable crude steel in the required volume and process it further.

A ULC (ultralow carbon) steel grade is understood to mean a steel grade having a carbon content C of not more than 150 ppm (0.015% by weight), especially not more than 100 ppm, preferably not more than 50 ppm, especially not more than 30 ppm.

IF steel is understood to mean a ULC steel grade that additionally has a nitrogen content N of not more than 50 ppm (0.005% by weight), preferably not more than 30 ppm.

Non-grain-oriented electrical strip grade is understood to mean an IF steel additionally having a silicon content Si of 1.0-5.0%, preferably 2.0-4.0%.

The element contents mentioned for the steel grades are based on the solidified steel after casting, for example in a continuous casting plant.

There is particular emphasis here on the nitrogen content of the crude steel produced, since this can be reduced only with difficulty by secondary metallurgy methods, especially when the oxygen content at the same time exceeds a certain content, as will be elucidated in detail later on.

It is therefore an object of the present invention to provide a process for producing low-nitrogen crude steel in which $CO_2$ emission is reduced and a maximum number of existing assemblies can continue to be used in order to minimize capital costs in the technological switchover.

This process for producing low-nitrogen crude steel comprises at least the following process steps:

- melting directly reduced iron and/or scrap in a melting furnace with arc resistance heating, especially with a reducing atmosphere, to give a metallic melt and a slag,
- removing the metallic melt from the melting furnace and using it to charge a converter,
- refining the metallic melt in the converter to give liquid crude steel and tapping the liquid crude steel having a nitrogen content N of not more than 70 ppm, especially of not more than 50 ppm.

Optionally, after the metallic melt has been removed from the melting furnace and before a converter has been charged, an intermediate treatment is conducted, especially a desulfurization of the metallic melt.

Alternatively or additionally, the intermediate treatment may comprise deslagging and/or desiliconization.

This method has many technical and economic benefits, which are elucidated in detail hereinafter.

The invention further relates to an assembly for performance of such a process. This assembly comprises a melting furnace with arc resistance heating for production of a metallic melt and a converter disposed downstream of the melting furnace for refining of the metallic melt to give liquid crude steel. In a specific execution variant, a desulfurization plant is disposed immediately downstream of the melting furnace, and the converter immediately downstream of the desulfurization plant.

What is meant by "immediately downstream" and "immediately upstream" in the context of this application is that the respective plants follow on directly from one another. All that takes place between such directly successive plants is transport of the material and/or intermediate storage of the material. More particularly, between two such plants, the material is not purified, mixed with other substances or upgraded in any other way.

In the elucidation of element contents, the following conventions are used: an element symbol between square brackets (e.g. "[N]") denotes the content of that element (nitrogen here) in percent by weight in the metal melt. An element symbol between round brackets (e.g. "(P)") denotes the content of that element (phosphorus here) in percent by weight in the slag. An element symbol without brackets (e.g. "C") means the content of that element (carbon here) in percent by weight in the cast steel.

In this application, percentages (or ppm figures) should fundamentally be considered as percentages by weight, % by weight, unless explicitly stated otherwise.

Different types of electrical heating plants for melting of metal or heating of liquid metal are distinguished as follows:

1. Electric arc furnaces (EAF), which form arcs between the electrode and the metal. This includes the AC electric arc furnace (EAFac), the DC electric arc furnace (EAFdc) and the ladle furnace (LF).
2. Melting furnaces with arc resistance heating, which form arcs between the electrode and the charge or slag, or which heat the charge or slag by means of the Joule effect. This firstly includes submerged electric arc furnaces (SAF) in which the electrode is submerged in the charge or slag, for example AC submerged arc furnaces (SAFac) and DC submerged arc furnaces (SAFdc). Secondly, this also includes furnaces in which the electrode can end just above the slag. In this type of furnace, the slag is not shielded by the charge at least in the region of the electrode. The slag is thus open at the top end, and the brush arc that forms to the slag can be seen from above. This type of furnace is also referred to as an open slag bath furnace (OBSF).

Electric arc furnaces are operated with an oxidizing atmosphere in order to burn the unwanted trace elements. By contrast, melting furnaces with arc resistance heating are operated with a reducing atmosphere.

In a first step of the process, directly reduced iron and/or scrap is melted in a melting furnace with arc resistance heating to give a metallic melt, and a slag is formed at the same time.

According to the invention, the treatment in the melting furnace with arc resistance heating is followed by use of the metallic melt to charge a converter and refining thereof in the converter to give liquid crude steel. In particular, the refining involves using a retractable probe to blow oxygen of technical grade purity from above onto the metallic melt, especially using 30 to 80 $m^3$ (STP) (standard cubic meters) of oxygen of technical grade purity per tonne of metallic melt, preferably 40 to 60 $m^3$ (STP) of oxygen of technical grade purity per tonne of metallic melt. The oxygen is blown onto the metallic melt for a period of 10 to 40 minutes. The period is preferably at least 12 minutes, more preferably at least 15 minutes. Independently of this, the period is preferably not more than 35 minutes, more preferably not more than 30 minutes.

As is well known, a converter is used for oxidative removal of trace elements. This especially relates to the carbon, such that, in the converter, the metallic melt is converted to crude steel having a carbon content [C] of not more than 600 ppm, preferably not more than 500 ppm. In particular, the carbon content [C] of the raw steel is at least 200 ppm, preferably at least 300 ppm. The converter here especially takes the form of an oxygen-blown converter.

In a subsequent secondary metallurgical treatment of the crude steel produced, which will be elucidated in more detail later on, the carbon content of the crude steel [C] is lowered further to the carbon content C of the ULC steel grade of not more than 150 ppm, especially not more than 100 ppm, preferably not more than 50 ppm, especially not more than 30 ppm.

Oxygen-blown converters, also referred to in the jargon as Linz-Donauwitz converters (LD converters), include a tiltable converter vessel lined with a refractory lining.

The metallic melt withdrawn from the melting furnace is used to charge the converter. Optionally, the converter is additionally charged with scrap that serves as coolant. It is optionally also possible to add pig iron from a blast furnace process. This will be the case, for example, during the retrofitting of an existing assembly.

The metallic melt is refined in the converter. This involves blowing oxygen onto the metallic melt by means of a retractable water-cooled probe. The subsequent violent onset of oxidation of the iron and of the trace elements has the effect that, after a blowing time of 10 to 40 minutes, the trace elements have been reduced to the desired degree and any scrap used has melted. The burnt iron-accompanying substances escape as gases or are bound in the liquid slag by lime that has now been added.

As well as the reduction of the unwanted trace elements, the exothermic reaction thereof with the oxygen blown in ensures gyration of the melt, which improves the outcome of the refining process and shortens the treatment time. In order to further intensify this mixing, it is possible to blow an inert gas, typically argon and nitrogen, through nozzles inserted into the converter base. As elucidated hereinafter, in accordance with the invention, the refining also reduces the nitrogen content. Therefore, the inert gas used for the mixing is preferably argon. Alternatively, the nitrogen content in the inert gas is reduced during refining, such that there is only a small nitrogen content, if any, in the inert gas toward the end of refining.

As well as other process that will also be elucidated later on, CO bubbles are formed within the metallic melt by oxidation of carbon as trace element. On account of the low partial nitrogen pressure in the CO bubbles, the nitrogen [N] dissolved in the metallic melt will diffuse into the CO bubbles and leave the melt together with the CO. This denitrification process proceeds for as long as CO bubbles form, i.e. for as long as there is sufficient carbon in the metallic melt that can be oxidized to CO. For the denitrification process, it is therefore advantageous when the metallic melt, immediately prior to the refining, has a ratio of carbon content to nitrogen content [C]/[N] of at least 20, preferably at least 100, especially at least 200, more preferably at least 500, especially at least 1000.

In a preferred execution variant, the carbon content [C] of the metallic melt immediately prior to refining is at least 1.0%, preferably at least 1.5%, more preferably at least 2.0%. In a further preferred execution variant, the carbon content [C] of the metallic melt immediately prior to refining is not more than 5.0%, preferably not more than 4.5%, more preferably not more than 4.0%.

With these carbon contents [C] and the high ratio of carbon content to nitrogen content [C]/[N] described, even in the case of nitrogen contents [N] of the metallic melts immediately prior to refining of up to 450 ppm, it is possible to achieve effective denitrification, such that the tapped liquid crude steel after the refining has a nitrogen content [N] of not more than 50 ppm, preferably not more than 40 ppm, especially not more than 30 ppm, more preferably not more than 25 ppm, especially not more than 20 ppm.

The converter is especially in largely closed form, in order to reduce reintroduction of nitrogen from the surrounding atmosphere, and especially to prevent it completely. This is additionally assisted by the formation of CO. The amount of CO is so large that the ambient air is displaced at the surface of the melt, such that the intake of nitrogen from the ambient air is suppressed.

Since there can be a certain degree of incorporation of nitrogen in secondary metallurgy treatment and/or in the casting of crude steel, it is advantageous when the nitrogen content is lowered in the refining operation in the converter to a greater degree than actually required for the steel grade to be achieved. For example, in the production of an IF steel grade with a nitrogen content N of not more than 30 ppm, the nitrogen content [N] of the liquid crude steel after refining is lowered to a maximum of 25 ppm, preferably to a maximum of 20 ppm.

The process of the invention described firstly enables successfully lowering the nitrogen content when the nitrogen content of the metallic melt is above 50 ppm, and, secondly, it is possible in the case of nitrogen contents below 50 ppm to keep the nitrogen content low or even lower it further. As a result, the nitrogen content [N] of the liquid crude steel after refining is in any case 50 ppm or less.

In a preferred execution variant, the carbon content [C] of the metallic melt is increased in the melting furnace and/or in the converter. The carbon content is thus increased before the refining in the converter. This serves to ensure that sufficient CO bubbles are formed during the refining in order to enable an efficient denitrification process. In particular, the carbon content [C] of the metallic melt is increased to such an extent that, immediately before the refining, there is a ratio of carbon content to nitrogen content [C]/[N] of at least 20, preferably at least 100, especially at least 200, more preferably at least 500, especially at least 1000.

The carbon content [C] of the metallic melt is especially achieved by blowing in coke or process gases/coal dust in the melting furnace or converter.

In a preferred embodiment, the iron content (Fe) of the slag in the melting furnace is less than 30% by weight, preferably less than 20% by weight. This makes the process particularly efficient since the loss of iron via the slag is particularly low. Such low iron contents can especially be achieved by the use of the melting furnace with arc resistance heating. In an electric arc furnace operated under oxidizing conditions, the oxidizing atmosphere results in higher yield losses in the form of FeO in the slag, which means that use of this type of melting furnace is less efficient. The combination of a melting furnace with arc resistance heating with a downstream converter is therefore more efficient for physical purposes than an electric arc furnace, which combines melting and oxidation in one step. Incidentally, the melting furnace with arc resistance heating is also more energy-efficient since there are high energy losses in an electric arc furnace in the case of an arc which is not well shielded by foaming slag.

In a further preferred execution variant, the melting furnace with arc resistance heating is in a closed configuration. This firstly prevents loss of heat and additionally reduces the introduction of oxygen, such that a reducing furnace atmosphere is maintained and hence oxidation losses are low.

Another means of reducing the nitrogen content would be a vacuum treatment (e.g. Ruhrstahl-Heraeus process, RH process) in secondary metallurgy. However, this is possible only to a limited degree in the production of ULC steel grades. The extremely low carbon content of 150 ppm, especially 50 ppm, preferably 30 ppm, in the case of ULC steel grades is achieved by the refining in the converter and a downstream secondary metallurgy treatment (here a vacuum treatment). However, this leads simultaneously to enrichment of dissolved oxygen in the crude steel in the refining operation. The oxygen content [O] in the crude steel downstream of the converter is between 300 and 2300 ppm. In particular, the oxygen content is at least 400 ppm, preferably at least 600 ppm, more preferably at least 800 ppm. In particular, the oxygen content is not more than 2100 ppm, preferably not more than 2000 ppm, more preferably not more than 1800 ppm. However, the effect of this oxygen content is that denitrification to the specified nitrogen contents [N] of 50 ppm or less by means of vacuum treatment does not proceed efficiently. Research has shown that such a vacuum denitrification is performable within an economically viable period of time only in the case of the lowest oxygen contents [O] of 100 ppm or less.

Vacuum denitrification in secondary metallurgy would additionally give rise to further problems. Firstly, an additional investment for the corresponding assemblies would be required. Secondly, any change in the secondary metallurgy methods in the production of a steel grade would require the production process to be respecified for the final customer. The process of the invention for production of a crude steel has the advantage over this that the further upgrading in secondary metallurgy remains unchanged and, consequently, no recertification is required.

The process of the invention can thus produce a low-nitrogen crude steel which is simultaneously particularly low in carbon and can therefore be used as starting product for the production of ULC steel grades. In particular, the carbon content of the crude steel is less than 600 ppm, preferably less than 500 ppm, and the nitrogen content is less than 50 ppm, preferably less than 30 ppm.

In the conventional electrical steel route with an electric arc furnace, oxygen is likewise blown in, for the purpose of removing carbon among others, but the design of the furnace means that the input of oxygen is limited, and so the carbon content cannot be lowered as far. The smaller input of oxygen in the refining also means that there is no efficient denitrification via the described CO bubbles in the conventional electrical steel route. Secondly, the melt furnaces of this kind are operated with an oxidizing atmosphere (i.e. under ambient air), and so there is introduction of nitrogen from the surrounding atmosphere. Moreover, such furnaces have a flat design, by contrast with a converter, which further promotes the introduction of nitrogen.

A further advantage of the process of the invention is the low silicon content of the liquid crude steel after tapping in the converter. On refining in the converter, silicon is oxidized very effectively and subsequently discharged by the slag, and so the Si content [Si] upstream of the converter is irrelevant. The Si content of the tapped liquid crude steel is not more than 300 ppm, preferably not more than 200 ppm.

In the case of typical starting materials, the Si content [Si] of the metallic melt on charging into the converter may be up to 1.5%.

A further advantage of the process of the invention with a converter over the conventional electrical steel route with an electric arc furnace lies in the slag content. While it is possible to achieve a slag content of 100-120 kg/t in the converter, the slag content in the case of an electric arc furnace is only about 50 kg/t. Moreover, the effect of the greater standard volume flow rate in the refining in the converter is that there is significant mixing of slag and melt. The result is an emulsion of melt droplets in the slag. This leads to a greater reactive surface area between melt and slag, which has a positive effect on dephosphorization. Moreover, the deposition of phosphorus as $P_2O_5$ in the slag is an equilibrium reaction. It is therefore advantageous to achieve a maximum slag content if a maximum amount of phosphorus from the melt is to be deposited in the slag. When a converter is used, the result is a phosphorus distribution (P)/[P]=60-80% by weight/% by weight, whereas, in the case of an electric arc furnace, the same ratio is only 30-40% by weight/% by weight. Moreover, the composition of the slag in the case of an electric arc furnace is optimized for the foaming for the foaming slag method and not for the dephosphorization. The phosphorus content [P] of the metallic melt immediately before refining is between 100 ppm and 1500 ppm. The phosphorus content [P] of the tapped liquid crude steel is, by contrast, not more than 400 ppm.

As already elucidated, a desulfurization can optionally be conducted after the removal of metallic melt from the melting furnace and before charging into a converter. For this purpose, in particular, calcium oxide and/or calcium carbide and/or magnesium is added to the metallic melt. In this case, there is reaction essentially of the iron sulfide FeS present to give calcium sulfite Cas or magnesium sulfite MgS. The CaS or MgS formed is then bound in a basic slag.

The sulfur content [S] of the metallic melt immediately prior to refining (and hence after the optional desulfurization) is up to 1500 ppm. The sulfur content [S] of the tapped liquid crude steel is likewise up to 1500 ppm.

Optionally, the metallic melt and the tapped liquid crude steel may contain manganese. In such a case, the manganese content [Mn] of the metallic melt immediately prior to refining is up to 0.5%. The manganese content [Mn] of the tapped liquid crude steel is, by contrast, not more than 0.4%.

Optionally, the metallic melt and/or the tapped liquid crude steel may contain further unavoidable impurities that may add up to 2.0%.

The iron content [Fe] of the metallic melt immediately prior to refining is at least 90.0%. The iron content [Fe] of the tapped liquid crude steel is at least 97.0%.

In a preferred variant, the metallic melt immediately prior to refining has at least one, preferably more than one and especially all element contents of trace elements from the following collation:

- carbon [C]: at least 1.0%, especially at least 1.5%, not more than 5.0%, especially not more than 4.5%,
- nitrogen [N]: not more than 450 ppm, especially more than 50 ppm,
- optionally oxygen [O]: 0-50 ppm,
- optionally phosphorus [P]: 100-1500 ppm,
- optionally sulfur [S]: 0-1500 ppm,
- optionally silicon [Si]: 0-1.5%,
- optionally manganese [Mn]: 0-0.5%.

In particular, the metal melt contains, immediately prior to refining:

- carbon [C]: at least 1.0%, especially at least 1.5%, not more than 5.0%, especially not more than 4.5%,
- nitrogen [N]: not more than 450 ppm, especially more than 50 ppm,
- optionally oxygen [O]: 0-50 ppm,
- optionally phosphorus [P]: 100-1500 ppm,
- optionally sulfur [S]: 0-1500 ppm,
- optionally silicon [Si]: 0-1.5%,
- optionally manganese [Mn]: 0-0.5%,
- balance: iron and unavoidable impurities, where the impurities add up to not more than 2.0%.

In a preferred variant, the tapped liquid crude steel has at least one, preferably more than one and especially all element contents of trace elements from the following collation:

- carbon [C]: not more than 600 ppm, especially not more than 500 ppm,
- nitrogen [N]: not more than 50 ppm, especially not more than 30 ppm,
- oxygen [O]: at least 300 ppm, not more than 2300 ppm,
- optionally phosphorus [P]: 0-400 ppm,
- optionally sulfur [S]: 0-1500 ppm,
- optionally silicon [Si]: 0-300 ppm,
- optionally manganese [Mn]: 0-0.4%.

In particular, the tapped liquid crude steel contains:

- carbon [C]: not more than 600 ppm, especially not more than 500 ppm,
- nitrogen [N]: not more than 50 ppm, especially not more than 30 ppm,
- oxygen [O]: at least 300 ppm, not more than 2300 ppm,
- optionally phosphorus [P]: 0-400 ppm,
- optionally sulfur [S]: 0-1500 ppm,
- optionally silicon [Si]: 0-300 ppm,
- optionally manganese [Mn]: 0-0.4%,
- balance: iron and unavoidable impurities, where the impurities add up to not more than 2.0%.

The process of the invention with a converter has the further advantage that the composition of the melting furnace slag can be adjusted freely, whereas the slag in the case of an electric arc furnace is generally optimized and therefore cannot be varied as desired.

The composition may thus be adjusted, for example, similarly to the composition of foundry sand. It is therefore possible for the melting furnace slag, analogously to foundry sand, to have further uses, for example, in the cement industry.

In a preferred execution variant, the melting furnace with arc resistance heating comprises at least one electrode configured as a Søderberg electrode.

A Søderberg electrode comprises an outer shell, on the inside of which there is an arrangement of fins (called guide plates). The outer shell is filled continuously with electrode mass, for example in the form of briquettes or in the form of blocks or cylinders. Since the electrode wears away in the region of the end facing the melt, the electrode is lowered continuously in operation and refilled from the top with electrode material. In addition, the outer shell is continuously extended by welding-on of further material.

In a preferred execution variant, the melting furnace with arc resistance heating comprises exactly three electrodes and is operated with three-phase AC.

In a preferred execution variant, the process comprises an upstream direct reduction process for production of the directly reduced iron. The assembly in that case comprises a direct reduction plant upstream, preferably immediately upstream, of the melting furnace with arc resistance heating. In this direct reduction process, a solid-state reaction takes place, in which oxygen is removed from the iron ore. For this purpose, it is conventional to use charcoal or natural gas as a reducing agent. There have recently also been frequent proposals of hydrogen as a reducing agent. The reaction takes place below the melting point of iron ore, and so the outward form of the ores remains unchanged. Since the removal of oxygen results in a reduction in weight of about 27-30%, the result is a honeycomb microstructure of the reaction product (solid porous iron with many air-filled interstices). Therefore, the directly reduced iron is frequently also referred to as iron sponge.

In a preferred execution variant, the direct reduction plant comprises a shaft furnace with a reduction zone through which the iron ore passes counter to the reduction gas.

In a specific variant of the process, the reduction zone is disposed above a cooling zone in the shaft furnace. The iron ore then passes through the shaft furnace in vertical direction from the top downward. Such shaft furnaces enable good flow of cooling gas through the iron ore and reduction gas on account of the underlying chimney effect. In particular, the reduction gas flows through the reduction zone counter to a direction of movement of iron ore. Correspondingly, the cooling gas likewise flows through the cooling zone counter to a direction of movement of the iron sponge produced. Both in the cooling zone and in the reduction zone, the countercurrent method is accordingly used in order to achieve an efficient reaction between the gases and the solids.

The reduction gas used is especially CO or $H_2$ or a mixed gas comprising CO and $H_2$. The reduction reactions here are as follows ("(s)" means solid; curly brackets indicate gaseous substances):

$$3Fe_2O_3(s)+\{CO\}=2Fe_3O_4(s)+\{CO_2\}$$

$$Fe_3O_4(s)+\{CO\}=3FeO(s)+\{CO_2\}$$

$$FeO(s)+\{CO\}=Fe(s)+\{CO_2\}$$

$$3Fe_2O_3(s)+\{H_2\}=2Fe_3O_4(s)+\{H_2O\}$$

$$Fe_3O_4(s)+\{H_2\}=3FeO(s)+\{H_2O\}$$

$$FeO(s)+\{H_2\}=Fe(s)+\{H_2O\}$$

The reduction gas is typically produced from fossil hydrocarbons (e.g. natural gas or coking furnace gas). By way of example, the reaction is elucidated hereinafter for methane as starting material. Other hydrocarbons are likewise possible as starting material.

In a first execution variant, the reduction gas is produced in a gas reformer from methane, $CO_2$ and steam (MIDREX® process).

$$CH_4+CO_2=2CO+2H_2$$

$$CH_4+H_2O=CO+3H_2$$

The result is a gas circuit in which fresh methane is mixed with the cleaned offgas from the shaft furnace upstream of the gas reformer. The offgas from the shaft furnace contains $CO_2$ and steam as products of the reduction reaction. With the aid of a catalytic reaction in the gas reformer, the reduction gas comprising $H_2$ and CO is produced from methane, $CO_2$ and steam. This reduction gas is fed to the shaft furnace, where it reduces the iron ore according to the reaction equations above. Reaction products formed are $CO_2$, steam and iron sponge. $CO_2$ and steam and unconsumed reduction gas are mixed with methane and fed back to the gas reformer.

In an alternative execution variant (HYL® process), the reduction gas is produced via the catalytic reaction $$CH_4+H_2O=CO+3H_2$$

by mixing methane with steam, heating the mixture and passing it over a catalyst. The catalyst may, for example, be nickel present in iron-nickel pipes that conduct the gas to the shaft furnace. In a specific configuration of this process, the hot iron sponge itself serves as catalyst in the lower portion of the reduction zone. At the same time, there is deposition of carbon on the iron sponge, which increases the carbon content of the iron sponge.

The reduction gas used may alternatively also be hydrogen, which especially is produced in a climate-neutral manner by means of electrolysis. The process in that case additionally comprises the following step:

producing directly reduced iron from iron ore in a shaft furnace with consumption of electrolytically produced hydrogen.

The use of electrolytically produced hydrogen reduces $CO_2$ output and the consumption of fossil energy carriers and hence improves the carbon footprint of the process.

This hydrogen can either fully replace natural gas as starting material or be added in part to the processes described above in order to reduce natural gas consumption. With rising hydrogen content, the reduction is shifted ever further to the specified reaction equations with $H_2$ and hence away from the three reaction equations with CO.

In a preferred development of the process, the direct reduction process includes a carburization step in which the directly reduced iron produced is contacted with a carbon-containing gas, such that carbon is deposited on the iron produced. The carbon-containing gas used may especially be natural gas or $CO_2$. According to the gas used, various chemical reaction mechanisms occur in this carburization reaction. The carbon-containing gas is preferably introduced into the cooling zone of the shaft furnace in order simultaneously cool and carburize the directly reduced iron produced. In addition, the hot, directly reduced iron in the cooling zone can additionally act as catalyst for the carburization reaction. The carburization step increases the carbon content of the directly reduced iron and hence also the carbon content of the metallic melt in the downstream melting furnace. This results in two advantages: firstly, there is a drop in the melting point of the directly reduced iron, which reduces energy consumption in the melting furnace. Secondly, as already elucidated, a higher carbon content is advantageous for the denitrification mechanism described in the downstream converter.

The invention further relates to a process for producing a ULC steel, especially an IF steel, preferably a non-grain-oriented electrical strip, comprising the following steps:

producing low-nitrogen crude steel by the process described above, secondary metallurgy treatment of the crude steel produced, casting the crude steel in a continuous casting plant.

This process has the same advantages as the above-elucidated process for producing low-nitrogen crude steel.

The secondary metallurgy treatment of the crude steel produced especially comprises a vacuum treatment.

In the vacuum treatment, the carbon content [C] of the crude steel produced of not more than 600 ppm is reduced to the desired maximum content of the ULC steel grade of not more than 150 ppm, preferably not more than 100 ppm, preferably not more than 50 ppm, especially not more than 30 ppm. The vacuum treatment is especially effective with the aid of the Ruhrstahl-Heraeus process. Alternatively, the vacuum treatment can be effected with the aid of ladle tank degassing.

The invention further relates to an assembly for performance of the above-described process. This assembly comprises a melting furnace with arc resistance heating for production of a metallic melt, with a converter downstream, preferably immediately downstream, for refining of the metallic melt to give liquid crude steel.

This assembly has the advantages that have been elucidated above in relation to the process.

In a preferred execution variant, the assembly comprises a direct reduction plant upstream, preferably immediately upstream, of the melting furnace with arc resistance heating and/or a secondary metallurgy plant downstream, preferably immediately downstream, of the converter. The direct connection of the direct reduction plant to the melting furnace has the advantage that the directly reduced iron produced can be used to charge the melting furnace while still hot. This reduces the energy input in the melting operation. Likewise advantageous is the direct connection of the secondary metallurgy plant to the converter, since the liquid crude steel can thus be fed directly to the further processing.

The invention likewise relates to an assembly for performance of the above-described process for producing a ULC steel. This assembly comprises a melting furnace with arc resistance heating for production of a metallic melt, with a downstream converter for refining of the metallic melt to give liquid crude steel, a secondary metallurgy plant downstream of the converter, and a continuous casting plant downstream of the secondary metallurgy plant. The secondary metallurgy plant is especially designed as a vacuum degassing plant, preferably an RH plant.

The invention further relates to a retrofit of an existing assembly for production of low-nitrogen crude steel having a blast furnace and an existing converter downstream of the blast furnace, by adding a melting furnace with arc resistance heating upstream, preferably immediately upstream, of the existing converter and decommissioning the existing blast furnace. It has been found that, surprisingly, a low-nitrogen crude steel can be produced with distinctly reduced $CO_2$ emission, by using, rather than an existing blast furnace, a melting furnace with arc resistance heating upstream of the existing converter. Such melting furnaces have to date not been coupled to a separate converter in order to produce particular steel grades. Separate converters have to date been known only in combination with blast furnaces. It has been recognized in accordance with the invention that the blast furnace can be replaced by a simple melting furnace with arc resistance heating as described. This combination results in the synergistic effects elucidated with regard to the process. One of these in particular is the particularly low nitrogen content of the crude steel produced. In addition, this retrofit can be implemented comparatively inexpensively since the existing converter can still be used. It is likewise possible on account of the low nitrogen content to continue to use the secondary metallurgy plants further downstream in an identical manner. This has the advantage that no recertification of the production process for a steel grade for the final customer is required. Since the certification of the production process relates solely to the process steps downstream of the converter, it is possible to avoid recertification if these steps remain unchanged. The retrofit of the invention permits adoption of exactly these steps unchanged from the blast furnace process.

The invention further relates to a retrofit of existing assembly for production of ULC steel grades, comprising a blast furnace, an existing converter downstream of the blast furnace, and a secondary metallurgy plant downstream of the converter. The process comprises the addition of a melting furnace with arc resistance heating upstream, preferably immediately upstream, of the existing converter and the decommissioning of the existing blast furnace. This process of retrofitting an existing assembly for production of ULC steel grades has the same advantages as the above-elucidated process for retrofitting an existing assembly for production of low-nitrogen crude steel, since the low-nitrogen crude steel is used as starting material for the production of ULC steel grades.

In a preferred variant, the two aforementioned retrofitting processes comprise the addition of a direct reduction plant upstream, preferably immediately upstream, of the melting furnace with arc resistance heating. The direct connection of the direct reduction plan to the melting furnace has the advantage that the directly reduced iron produced can be used to charge the melting furnace while still hot. This reduces energy use in the melting operation.

Figure 2:
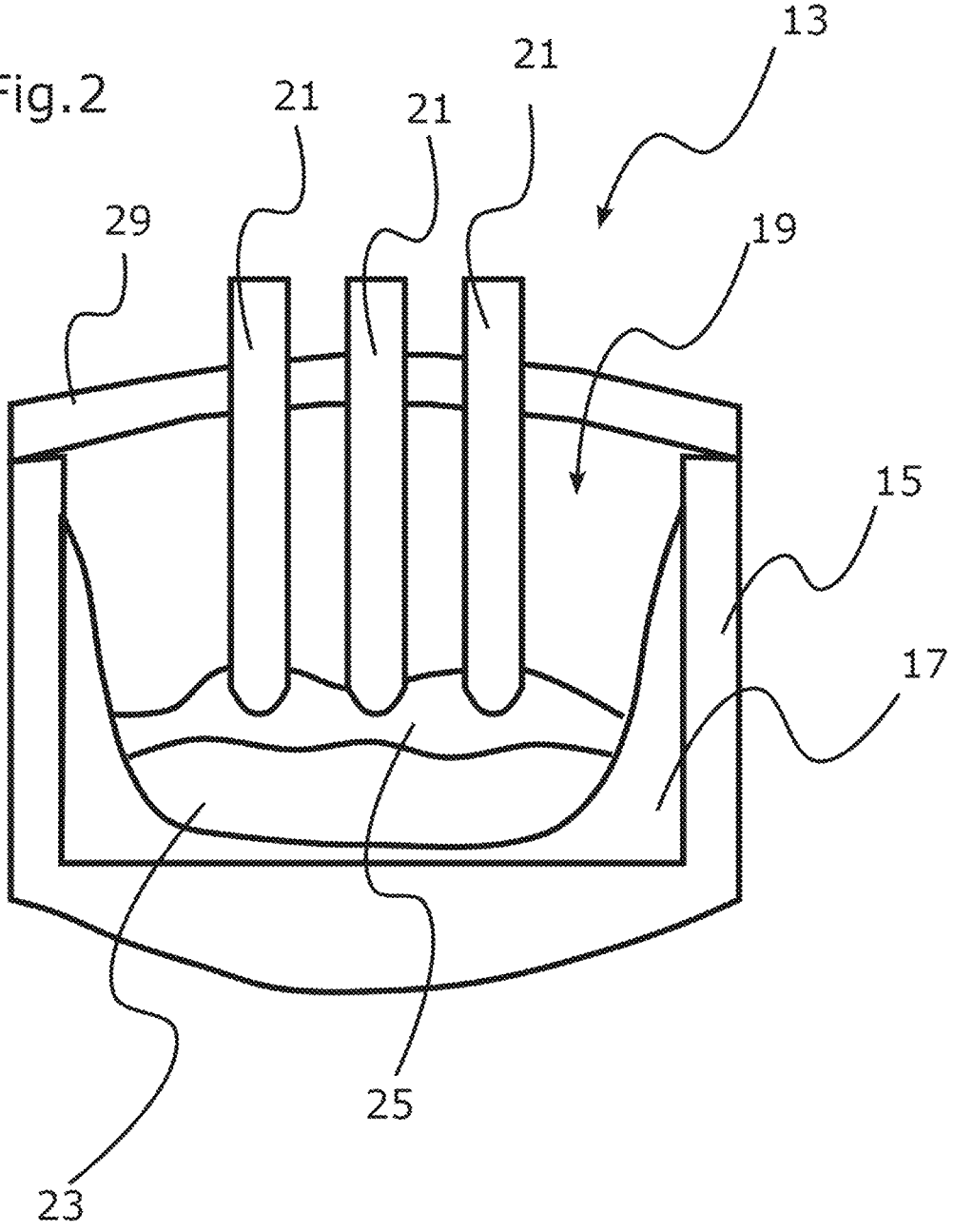
Figure 3:
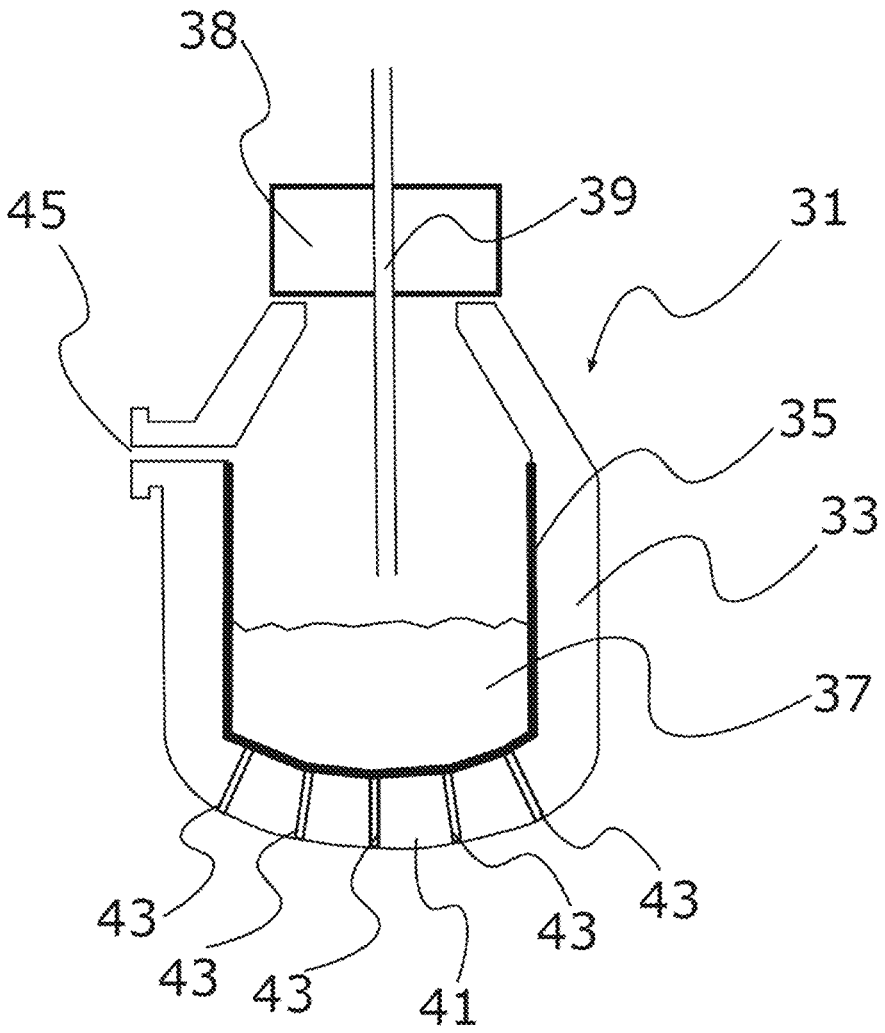
Figure 4:
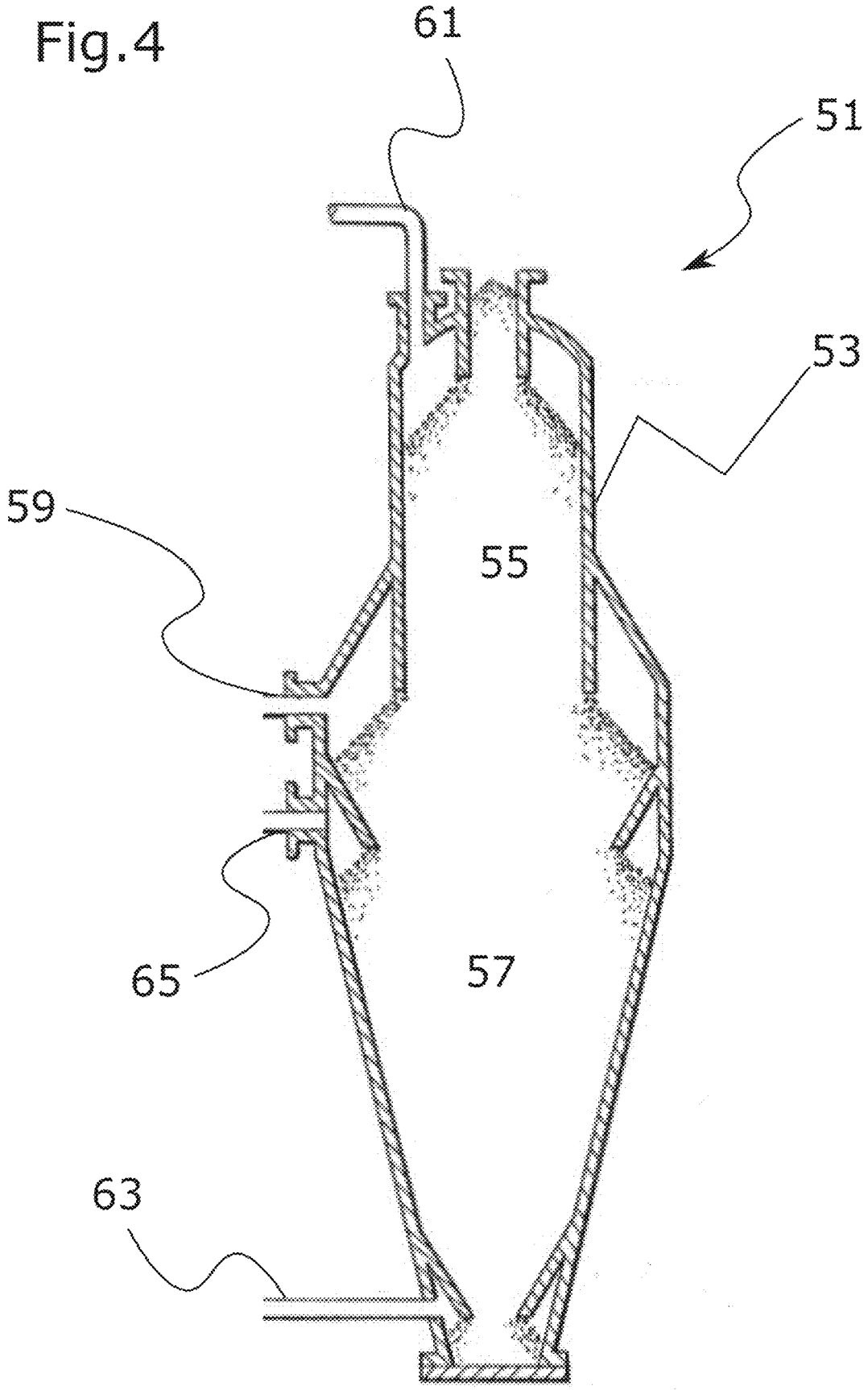

The invention is elucidated in more detail by the figures. The figures show:

FIG. 1 a flow diagram of the process of the invention for production of crude steel FIG. 2 a schematic diagram of a melting furnace with arc resistance heating FIG. 3 a schematic diagram of a converter FIG. 4 a schematic diagram of a direct reduction plant FIG. 1 shows a flow diagram of the process of the invention for production of low-nitrogen crude steel. In a first optional step, directly reduced iron is produced from iron ore in a shaft furnace. Alternatively, the directly reduced iron may also be bought in. In a subsequent step, the directly reduced iron is introduced into a melting furnace with arc resistance heating. In addition, it is optionally possible to introduce scrap as well into the melting furnace. In the melting furnace, iron and/or scrap are melted to give a metallic melt and a slag. Subsequently, the metallic melt is removed from the melting furnace and used to charge a converter. In the converter, the metallic melt is refined to give liquid crude steel. The liquid crude steel is subsequently tapped in the converter.

FIG. 2 shows a melting furnace with arc resistance heating 13 in the form of a submerged electric arc furnace (SAF). The melting furnace 13 comprises a furnace vessel 15 lined on the inside with refractory material 17. Three electrodes 21, which are operated with AC, project into the interior 19. The metallic melt 23 is already within the interior 19. A layer of slag 25 has settled out on the metallic melt 23. Three electrodes 21 project into the slag 25. A current is thus formed between the electrodes 21, which runs through the slag layer 25 and heats the slag layer 25 through resistance heating. This heating is transmitted from the slag layer 25 to the metallic melt 23. The interior 19 is concluded at the top by a lid 29, through which the three electrodes 21 project. The electrodes 21 are designed as Søderberg electrodes.

FIG. 3 shows a converter 31. The converter 31 comprises a converter vessel 33 having a refractory lining 35. In the converter vessel 33 is a metallic melt 37. A probe 39 that projects from the top into the converter vessel 33 can be used to blow oxygen onto the surface of the metallic melt 37. The converter 41 is closed at the top by a lid 38, through which the probe 39 is conducted. The converter base 41 has nozzles 43 through which an inert gas can be blown into the converter 31. The converter 31 has a lateral tapping orifice 45 through which the liquid crude steel can be removed by tilting the converter vessel 33 after the refining.

FIG. 4 shows a schematic diagram of a direct reduction plant 51. The direct reduction plant 51 comprises the shaft furnace 53. In the shaft furnace 53 there is a reduction zone 55 and a cooling zone 57. The reduction zone 55 is disposed above the cooling zone 57. The shaft furnace 53 is filled with iron ore from the top. At the lower end of the shaft furnace 53, the directly reduced iron produced can be removed. At the same time, reduction gas is admitted into the shaft furnace 53 through the inlet 59. The reduction gas then flows through the iron ore in the reduction zone 55. Unconsumed reduction gas then exits again together with any gaseous reaction products at the outlet 61. The reduction gas thus flows through the reduction zone 55 counter to a direction of movement of the iron ore. After leaving the reduction zone 55, the directly reduced iron enters the cooling zone 57. In the cooling zone 57, the cooling gas flows through the iron sponge counter to the direction of movement of the iron. For this purpose, the cooling gas enters the shaft furnace 53 through the inlet 63. Unconsumed cooling gas exits again at the outlet 65 together with any gaseous reaction products. It is of course also possible for a certain proportion of the cooling gas to enter the reduction zone 55. It is likewise possible for a certain proportion of the reduction gas to enter the cooling zone 57. The cooling gas is preferably carbon-containing in order to bring about carburization of the directly reduced iron produced.

The invention claimed is:

1. A process for producing low-nitrogen crude steel, comprising the following process steps:

melting directly reduced iron and/or scrap in a melting furnace with arc resistance heating with a reducing atmosphere to give a metallic melt and a slag, removing the metallic melt from the melting furnace and using it to charge a converter, refining the metallic melt, wherein the nitrogen content [N] is lowered when the nitrogen content [N] of the metallic melt is above 50 ppm, or kept low or lowered further when the nitrogen content [N] of the metallic melt is below 50 ppm, in the converter to give liquid crude steel and tapping the liquid crude steel having a nitrogen content [N] of 50 ppm or less, wherein the metallic melt, immediately prior to the refining, has a ratio of carbon content to nitrogen content [C]/[N] of at least 20.

2. The process as claimed in claim 1, wherein the carbon content [C] of the metallic melt is increased in the melting furnace and/or in the converter.

3. The process as claimed in claim 2, wherein the metallic melt, immediately prior to the refining, has a ratio of carbon content to nitrogen content [C]/[N] of at least 100.

4. The process as claimed in claim 3, wherein the iron content (Fe) of the slag in the melting furnace is less than 30 wt. % [30 wt.-%] by weight.

5. The process as claimed in any of claim 4, wherein the metallic melt immediately prior to the refining has the following contents of trace elements:

carbon [C]: at least 1.0 wt. %, not more than 5.0 wt. %,
nitrogen [N]: not more than 450 ppm,
optionally oxygen [O]: 0-50 ppm,
optionally phosphorus [P]: 100-1500 ppm,
optionally sulfur [S]: 0-1500 ppm,
optionally silicon [Si]: 0-1.5 wt. %,
optionally manganese [Mn]: 0-0.5 wt. %.

6. The process as claimed in claim 5, wherein the tapped liquid crude steel has the following contents of trace elements:

carbon [C]: not more than 600 ppm,
nitrogen [N]: not more than 50 ppm,
oxygen [O]: at least 300 ppm, not more than 2300 ppm,
optionally phosphorus [P]: 0-400 ppm,
optionally sulfur [S]: 0-1500 ppm,
optionally silicon [Si]: 0-300 ppm,
optionally manganese [Mn]: 0-0.4 wt. %.

7. The process as claimed in claim 6, wherein the refining involves using a retractable water-cooled probe to blow oxygen onto the metallic melt, wherein the blowing time is at least 10 minutes and wherein argon is blown in via nozzles in the converter base.

8. The process as claimed in claim 7, comprising the following preceding step:

producing directly reduced iron from iron ore in a shaft furnace with consumption of electrolytically produced hydrogen or with consumption of natural gas or with consumption of coking furnace gas.

9. The process as claimed in claim 2, wherein the metallic melt, immediately prior to the refining, has a ratio of carbon content to nitrogen content [C]/[N] of at least 200.

10. The process as claimed in claim 2, wherein the metallic melt, immediately prior to the refining, has a ratio of carbon content to nitrogen content [C]/[N] of at least 500.

11. The process as claimed in claim 2, wherein the metallic melt, immediately prior to the refining, has a ratio of carbon content to nitrogen content [C]/[N] of at least 1000.

12. A process for producing an ultra-low carbon steel, comprising the following steps:

producing low-nitrogen crude steel by the process as claimed in claim 8,
secondary metallurgical treatment of the crude steel produced,
casting the crude steel in a continuous casting plant.

13. The process as claimed in claim 12, comprising the addition of a direct reduction plant upstream of the melting furnace with arc resistance heating.

* * * * *